United States Patent [19]

Rozmus

[11] Patent Number: 4,641,910

[45] Date of Patent: Feb. 10, 1987

[54] ELECTRICAL CONTACTS

[76] Inventor: John J. Rozmus, 1030 Derwydd La., Berwyn, Pa. 19312

[21] Appl. No.: 641,674

[22] Filed: Aug. 17, 1984

Related U.S. Application Data

[63] Continuation-in-part of Ser. No. 553,161, Nov. 18, 1983, abandoned, which is a continuation of Ser. No. 295,748, Aug. 24, 1981, abandoned.

[51] Int. Cl.[4] ..... H01R 13/428

[52] U.S. Cl. ..... 339/221 R

[58] Field of Search ..... 339/17 C, 220 R, 221 R, 339/221 M, 252 R, 252 P

[56] References Cited

FOREIGN PATENT DOCUMENTS 278225 10/1927 United Kingdom ..... 339/252 P

*Primary Examiner*—Gil Weidenfeld
*Assistant Examiner*—Gary F. Paumen
*Attorney, Agent, or Firm*—Frederick J. Olsson

[57] ABSTRACT

(a) Contacts having mounting sections with mounting surfaces which provide for improved mounting characteristics and which also may function as electrical energy transfer surfaces, the contacts being formed by tooling connected to the punch pad and die pad bolsters of a progressive die operable as the contacts are being punched out to hug or impact opposite side edges of a contact and thereby form mounting and/or electrical energy transfer surfaces on the side edges.

(b) Contacts having retention sections, the retention sections having a pair of outboard arms and an inboard arm and which, when the retention section is inserted in a circuit board aperture, will be engaged to the outboard arms and function to prevent the metal of the outboard arms from being strained beyond the elastic limit and the outboard arms having surfaces formed by the tooling of (a).

(c) Contacts having electrical energy transfer surfaces which are continuous to thereby greatly improve reliability and reduce interconnection forces, such surfaces being formed by the tooling of (a).

3 Claims, 20 Drawing Figures

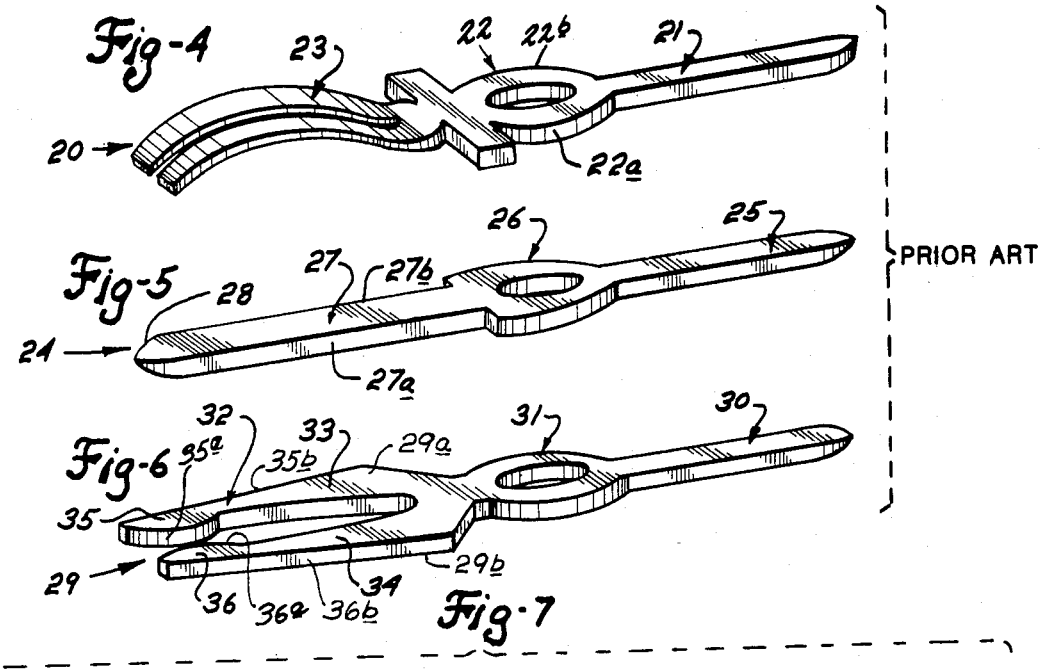
Fig-7
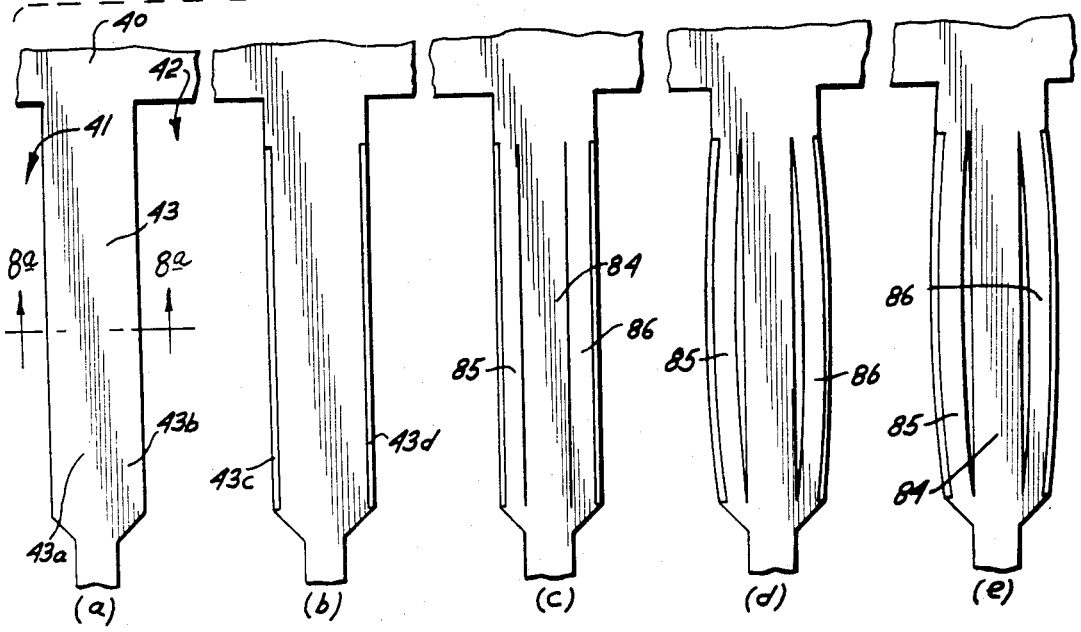
Fig-8
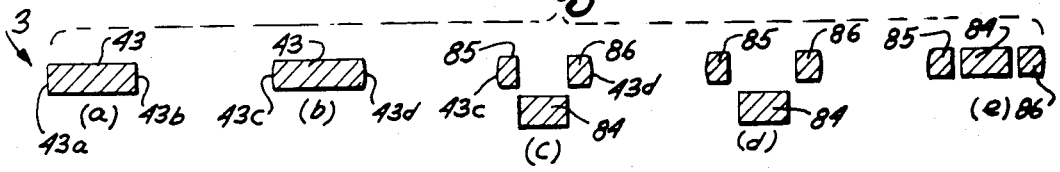

92
11
43c
43d
10
85
84
86
93

43c
43d
85
84
86

85
84
86
43c
43d 85
84
86
43d
43c
91
90

88
84
86
43c
43d 85
84
95
94
43c
94
43d
95

94
95
43c
94
95
96
43d
97

104
105
101
102
99
103
100
105

104
105
104
105
106
107

116
117
118
119
111
112
113
114
115
110
(a)
116b
118a
118b
117a
117b
119a
120
121
122
123
110
(c)
116
116b
117
118
118a
119
119a
117a
117b
118b
112
113
114
115
110
(b)
116b
117a
117b
118a
118b
119a
126
127
124
125
128
129
110
(d)

ELECTRICAL CONTACTS

This application is a continuation-in-part of application Ser. No. 553,161, filed Nov. 18, 1983 now abandoned, which is a continuation of my copending application Ser. No. 295,748 filed Aug. 24, 1981, now abandoned, and entitled ELECTRICAL CONTACTS AND TOOLING FOR MANUFACTURE OF SAME.

The invention in general relates to electrical spring contacts such as the pin, card edge, and tuning fork types normally fabricated by being punched out in a progressive die. Such contacts are used in the connectors and/or circuit boards for computer and communications equipment and the like. Improvements in such contacts and fabricating techniques which employ a progressive die are shown in my U.S. Pat. Nos. 3,990,864, 4,025,143, 4,099,043, and 4,162,572.

The contacts of the invention are made by tool means disclosed herein which are incorporated in a progressive die to function simultaneously with the punch and die means to form mounting and/or electrical energy transfer surfaces on the side edges of the contacts, the tool means including a pair of tiny heads connected to the punch pad and adapted, on the working stroke, to respectively enter the spaces on opposite sides of a contact and thence to hug and thereby work the side edge and also adapted, on the return stroke, to move away and release the worked edges. The principal advantage of the tooling is that it can produce continuous and/or contoured surfacing on the side edges of electrical spring contacts, which condition, insofar as I am aware, has not been attainable heretofore.

The tool means disclosed herein is also disclosed and claimed in co-pending application Ser. No. 553,168 filed concurrently herewith and entitled TOOLING FOR MANUFACTURE OF ELECTRICAL CONTACTS, the application being a division of said application Ser. No. 295,748.

In one aspect, the invention contemplates pin and tuning fork type contacts with continuous electrical energy transfer surfaces which provide the advantages of: maximum surface area for energy transfer: eliminating the likelihood of scraping off the gold plate on sockets inserted on pins and the gold plate on blades inserted between tuning forks and thereby maximizing reliability; and reducing the forces which must be developed to slide the parts together where there are multiple contacts.

In another aspect, the invention relates to improved retention sections for use in mounting pin, tuning fork, and card-edge type contacts in bores or apertures of a circuit board or the like, the retention section having yieldable arms each provided with a continuous semicircular side surface fabricated to be coincident with the circumference of the bore of the circuit board and which constitute mounting surfaces which are especially advantageous from the standpoint of inserting the retention section on the aperture, of maximizing the engagement area between contact and bore, and of enhancing the ability to follow thermal expansion and contraction of the circuit board.

In another aspect, the invention relates to contacts with surfacing of the kind in question wherein the surface is formed with fins running along its opposite edges, the fins being especially useful for mounting in applications where the boards are subject to severe physical conditions such as vibrations and the like.

In another aspect, the invention relates to contact retention sections having a pair of yieldable outboard arms provided with mounting surfaces of the kind mentioned and the retention section further including an inboard arm which, when the retention section is inserted in the aperture, will be engaged by the outboard arm so as to prevent the metal of the outboard arm from being strained beyond the yield point.

In another aspect, the invention contemplates that the mounting surfaces of the kind mentioned serve the additional function of constituting electrical energy transfer surfaces particularly where the aperture of the circuit board is plated.

The invention will be described below in connection with the following drawings wherein.

Figure 1:
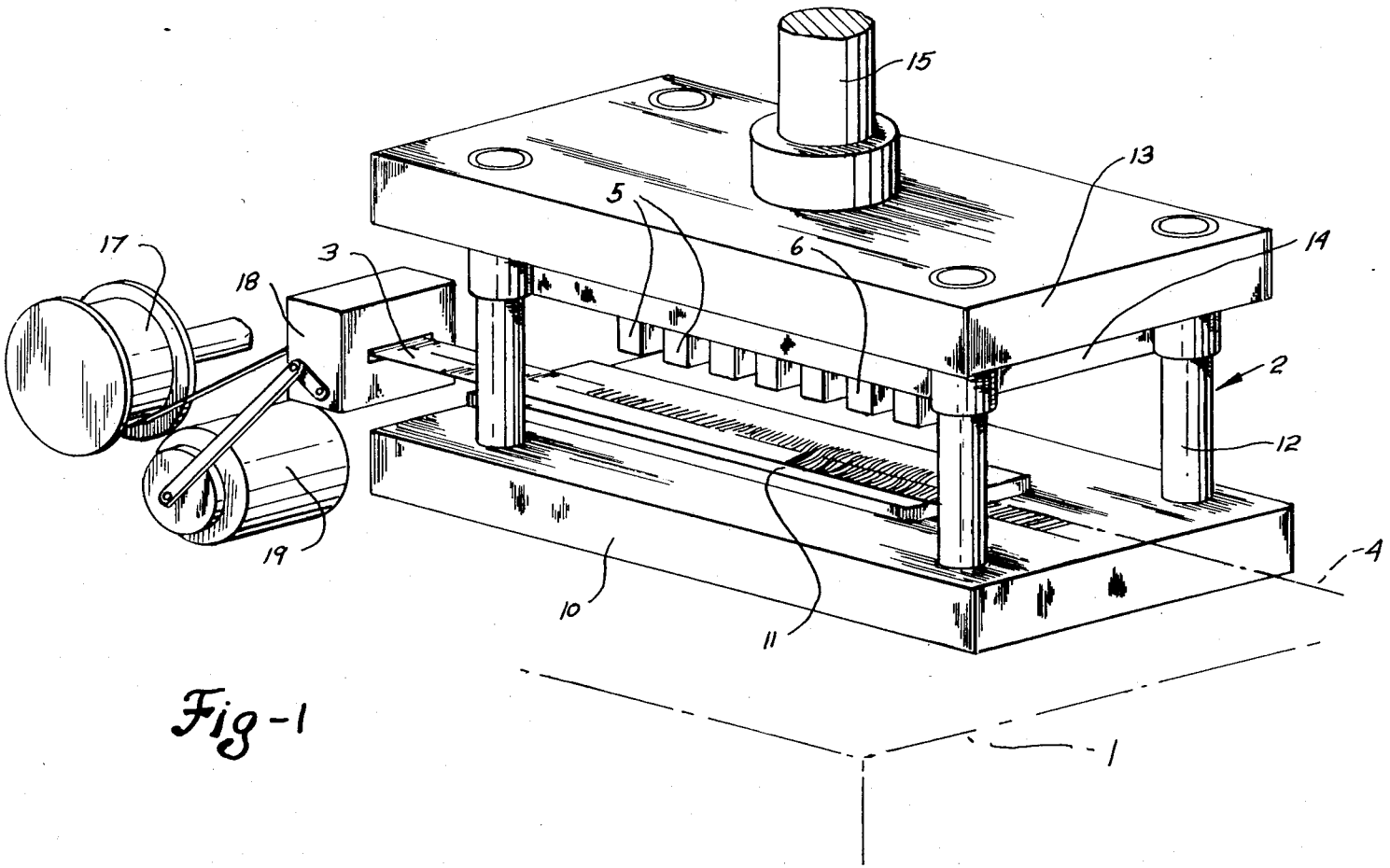
FIG. 1 is a perspective view of a press or stamping machine incorporating a progressive die to stamp out electrical spring contacts, the die incorporating the tooling of the invention.

FIG. 3-A is an enlarged fragmentary view of portions of the tooling of FIG. 1;

FIG. 3-B is a fragmentary view of the parts of FIG. 3 shown in position when the punch pad bolster has completed the working stroke and the tooling has completed the operation of hugging or impacting the side edges of a contact body for the forming of the mounting and/or electrical energy transfer surfaces;

FIG. 3-C is a fragmentary view illustrating the condition just before impact;

FIGS. 4, 5, and 6 are diagramatic perspective view respectively of conventional card-edge, pin, and tuning fork type contacts;

FIG. 7 is a view wherein parts (a) through (e) diagramatically illustrate various steps employed in fabricating a retention section having mounting and/or electrical energy surfaces;

FIG. 8 is an exploded view wherein parts (a) through (e) illustrate cross-sections taken through corresponding parts (a) through (e) of FIG. 7.

Figures 9, 10, 11, 12, 13, 14, 15, 16, 17, 18:
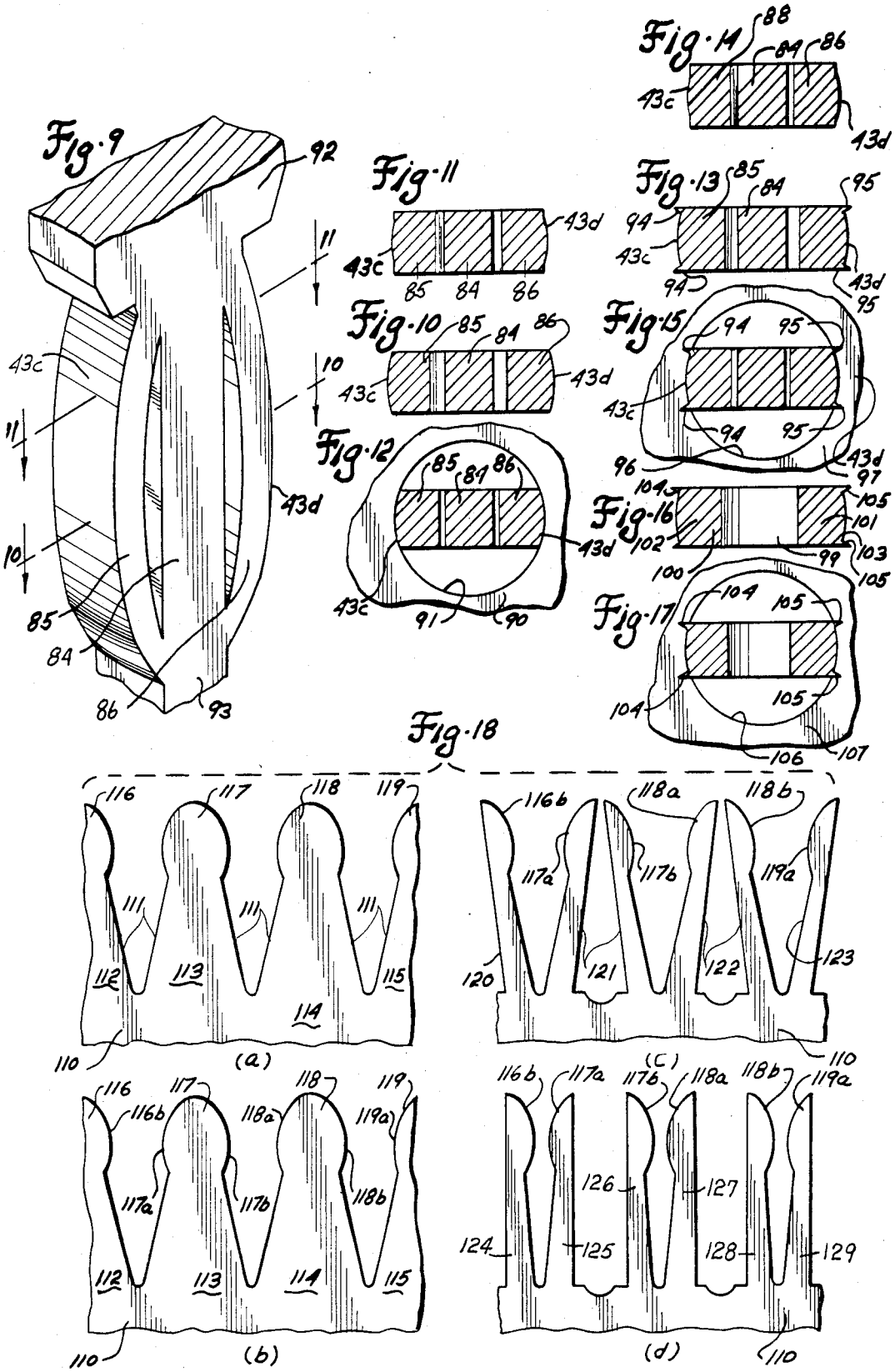

FIG. 9 is a fragmentary perspective view of the retention section fabricated by the steps of FIG. 7 and particularly illustrating the inboard arm and the outboard arms each of which has a mounting and/or electrical energy transfer surface;

FIG. 10 is a view taken along the lines 10—10 of FIG. 9;

FIG. 11 is a view taken along the lines 11—11 of FIG. 9;

FIG. 12 is a fragmentary plan view illustrating the retention section of FIG. 9 as disposed in the aperture of a circuit board;

FIGS. 13 and 14 are respectively views similar to FIGS. 10 and 11 and illustrating the mounting and/or electrical energy transfer surfaces on a retention section formed with edge fins;

FIG. 15 is a view similar to FIG. 12 and showing the retention section of FIGS. 13 and 14 as disposed in the aperture of a circuit board;

FIG. 16 is a cross-section of a retention section similar to the retention section of FIG. 9 except that the inboard arm has been eliminated and fins have been provided on the mounting and/or electrical energy transfer surfaces;

FIG. 17 is a view similar to FIGS. 12 and 15 illustrating the retention section of FIG. 16 disposed in a circuit board aperture; and FIG. 18 is a fragmentary view wherein parts (a) through (d) diagramatically illustrate the various steps employed in fabricating the contact section of a tuning fork type contact with electrical energy transfer surfaces.

Before proceeding with the description it is pointed out that the drawings herein are diagramatic and various of the parts are not shown in the precise proportional size. It will be understood that this is done for purposes of illustrating the best mode and the principles involved in the function, operation, and manipulation of the various components and additionally, because precise form and size are not critical per se and need only be compatible with intended function.

For simplicity of description, the mounting and/or electrical energy transfer surfaces mentioned above will be reffered to hereinafter as operating surfaces or surfacing. Also, it will be understood that the terms "mounting" and "transfer" refer to the portion of the surface which is in engagement with plated or unplated bore or aperture in a circuit board.

Referring to FIG. 1, a press or stamping maching 1 incorporates a progressive die 2 adapted to fabricate electrical spring contacts. The die 2 is set up and arranged to receive and work a flat body strip 3. The strip 3 is held horizontally and intermittently fed or stepped through the die along the axis 4 (from left to right) and worked into finished contacts. The die 2 is provided with punches 5 cooperating with mating dies not shown to punch out and form the strip and also provided with tooling of the invention, part of which is indicated at 6 operating simultaneously with the punches to form the operating surfaces of the invention. As is usual in a stamping machine, the stamping forces of the punches 5 are applied vertically or in a direction normal to the plane of the strip and function as by shearing the strip.

The die 2 includes the die bolster 10 mounted on the press and carrying the die pad 11. Guide pins 12 mounted on the die bolster 10 and carry the punch pad bolster 13 which in turn mounts the punch pad 14. The punch pad bolster 13 is adapted to be reciprocated by the press drive means as indicated at 15. The punch pad 14 moves in a working stroke from the return position shown in FIG. 1 down to a position above the pad 11 wherein the punches and dies and the tooling work the strip and thence back up on a return stroke to the return position.

The punch pad 14 carries the punches 5 and the die pad 11 carries the corresponding dies not shown. The respective mating punches and dies are spaced at stations along the axis 4. A stripper plate mechanism needed in dies of this kind has been omitted for purposes of clarity. It will be understood that the stripper plate guides the strip 3 along the axis 4 and maintains a strip against lateral movement.

The punch pad 14, in addition to the punches 5, carries part of the tooling 6 of the invention. As noted later, corresponding tooling is mounted on the die pad 11. It will be understood, of course, that the illustrations of the punches and the illustration of the tooling 6 on the punch pad 14 are representative only and are shown in exaggerated form for descriptive purposes. The actual physical structure of the punches and dies will be readily apparent to those skilled in the art particularly depending upon the type of contact which is to be fabricated.

As illustrated in FIG. 1, the punches 5 and the tooling 6 are in the return position ready to be moved downwardly against the strip 3 to work the same.

Referring back to the body strip 3, it will be observed that the strip is mounted on a roll 17. The strip is pulled off the roll and intermittently fed or stepped along between the punches and dies by the feed mechanism 18 operated by the motor mechanism 19. The intermittent motion of the feed 18 is coordinated with the reciprocating motion of the press drive 15 so that the punches 5 and the tooling 6 hit the strip during a dwell period and the feed of the strip takes place after the punches and tooling leave the stripper plate on the return stroke but before the next working stroke. This intermittent motion is conventional in presses of the kind being described.

A typical strip 3 employed in forming spring contacts has a rectangular cross-section with thickness of approximately 0.025 inches and a width of approximately 1 5/32 inches and is formed of a resilient copper alloy.

Before describing the tooling 6 and how the operating surfaces are formed, I refer to FIGS. 4, 5, and 6 which diagramatically show conventional spring contacts. These contacts are shown for use in illustrating the application of operating surfaces of the invention to such contacts.

In FIG. 4 the card edge contact 20 has a shank section 21, a retention surface 22, and a contact section 23. The retention section 22 is adapted to be inserted in a plated or non-plated aperture in the board and function to locate and retain the contact in position. The shank section 21 extends from one of the contacts and is adapted to be wire wrapped. A pair of contacts 20 are inserted back to back with the contact section 23 of each facing one another so as to receive an edge board therebetween.

In FIG. 5 the pin type contact 24 has a shank section 25, a retention section 26, and a contact or pin section 27. The shank section 25 and the retention section 26 are similar to those of corresponding parts as described in connection with FIG. 4. The pin section 27 is rectangular in cross-section and is provided with a pointed head 28. The pin section 27 is adapted to fit into a socket on an IC connector.

In FIG. 6 the tuning fork contact 29 has a shank section 30, a retention section 31, and a contact section 32 which comprises the forks 33 and 34 having heads 35 and 36. The shank and retention sections function as described above. The heads 35 and 36 are adapted to receive the blade of a connector.

Conventional retention sections of the kind illustrated in FIGS. 4, 5, and 6 are shown in FIG. 3 of U.S. Pat. No. Re 29,513 and in FIGS. 15–17 of U.S. Pat. No. 3,634,819.

Thus, during the fabrication of the retention sections of the contact of FIGS. 4, 5, and 6, the tooling of the invention is employed to work the side edges to create the operating surfaces of the invention, to wit the edges 22*a* and 22*b* of contact 20, the edges 26*a* and 26*b* of the contact 24, and the edges 31*a* and 31*b* of the contact 29. Also, during the fabrication of the contact 24 of FIG. 5, the side edges 27*a* and 27*b* of the pin or contact section 27 are worked so as to form operating surfaces to cooperate with the interior surfaces of the socket engaged with the section. Indeed the tooling of the invention may be employed to contour the point 28 to enhance the interconnection between the contact section 27 and the IC socket. The invention is especially appropriate for use in the forming of tuning fork contacts because in addition to providing operating surfaces on the retention section 31, side edges 35*a* and 36*a* of the fork heads can be provided with operating surfaces. These preferably are semi-spherical and produce a contact which for the first time will fully comply with military specifications. As noted, the edges 35*a* and 36*a* are facing interior side edges and the edges 35*b* and 36*b* are exterior side edges. These interior and exterior side edged extend between the flat parallel surraces 29*a* and 29*b* (which formerly were portions of the flat surfaces of the strip 3). Where the circuit board aperture is plated, the operating surfaces function both for mounting purposes and for the transfer of electrical energy between contact and circuits on the board.

Referring now to FIGS. 2, 3A, 3B, and 3C, I will describe the tooling 6. In FIGS. 2, 3A, 3B, and 3C, only the cross sections of the portions of the strip being worked are illustrated; for clarity, the other parts of the strip (and particularly the interconnections between the portions) illustrated are omitted.

Figure 2:
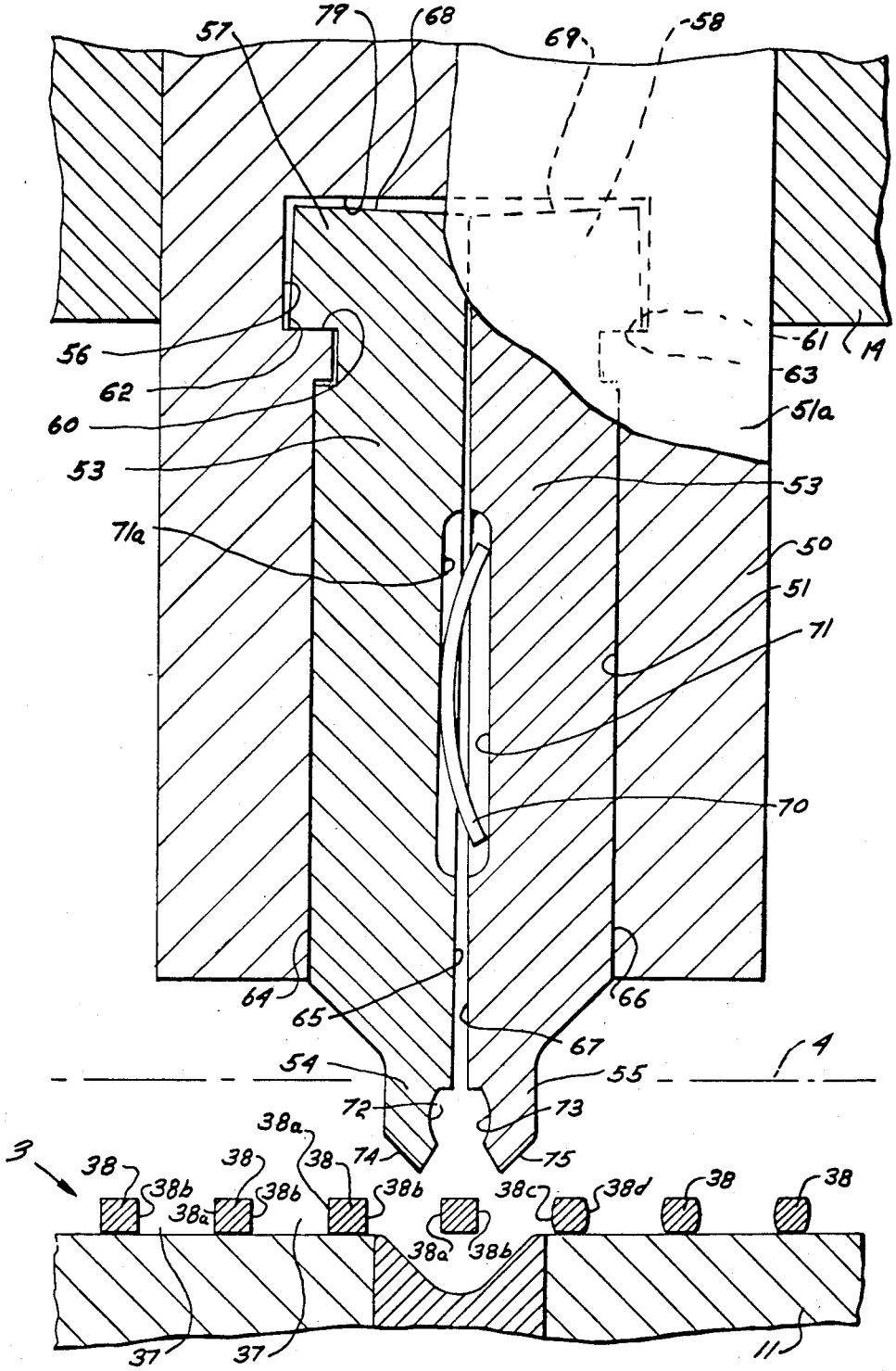
FIG. 2 is a side elevational view of tooling of the invention shown in position when the punch pad bolster of the progressive die is in the return station.

In punching out contacts of the kind above mentioned, the operation includes the forming of a contact body all or some of which is sized and/or shaped in accordance with the type and design of contact. For example, as described in my U.S. Pat. No. 3,990,864 and as indicated by the left-hand side of the strip 3 in FIGS. 3A, 3B, and 3C. In FIG. 2 the strip 3 (left-hand side) has been punched with cut-out sections 37; this punching operation forms the portions 38 of a contact body. The remainder of the contact body (not shown) is worked previously or subsequent to the forming of the portions 38. As these bodies 38 are stepped along the axis A (left to right), the side edges 38*a* and 38*b* are worked by the tooling 6 to contour the same as indicated (right-hand side of strip) at 38*c* and 38*d*. The above contact bodies may, for example, comprise the contact section such as section 27 of the pin contact of FIG. 5.

With the above in mind, I will now describe a preferred arrangement of the tooling 6. In connection with the description, it is to be remembered that the sizes involved are very small. For example, the contact bodies 43 may be in the order of 0.025 square inches and the distance between bodies in the order of 0.075 inches.

The tooling 6 includes the housing 50 which is fixed to the punch pad 14 on bolster 13 by conventional means (not shown). The housing reciprocates up and down with the punch pad bolster 13 and pad 14. The housing 50 has a cavity 51 which extends throughout the same (normal to the plane of the paper).

Within the cavity 50 are a pair of identical strikers 52 and 53 the lower ends of which have working heads 54 and 55. As noted later, these heads work the side edges of a contact body. The strikers are co-extensive with the cavity and are retained against lateral movement by end of plates secured to the housing and respectively extending across the opposite openings of the cavity. A fragment of one of these end plates is shown at 51*a* in FIG. 2. It will observed that the working heads 54 and 55 of the strikers extend outwardly from the housing.

The upper end of housing cavity 51 is enlarged as indicated at 56 and the upper heads 57 and 58 of the strikers are correspondingly enlarged. This forms the shoulders 60 and 61 on the housing and corresponding shoulders 62 and 63 on the strikers. As will be noted, the corresponding shoulders engage one another and serve to suspend the strikers in the cavity.

The dimensions of the cavity 51 and of the strikers 52 and 53 are set so as to provide lateral clearance (in the direction of axis 4) and also to provide vertical clearance. This is commented on following.

The dimensions of the enlarged end 56 of the cavity and the dimensions of the upper heads 57 and 58 are chosen so that the vertical dimension of the end 57 and of the end 58 is less than the vertical dimension of the enlarged end 56. This permits slight vertical shift of the strikers. The lateral dimensions (in the direction of the axis 4) of the enlarged end 56 of the cavity and of each of the upper heads 57 and 58 are chosen so that there is also lateral clearance in the direction of the axis 4. The strikers can shift slightly in the lateral direction.

It will be apparent from the foregoing description that the vertical and lateral shifting motion is confined in a plane which contains or is parallel to the axis 4, i.e. in the direction of the motion of the strip 3.

In addition to the lateral and vertical dimension characteristics mentioned above, the strikers are also tapered. Thus, striker 52 has its sides 64 and 65 tapered in an outward direction. Likewise the striker 53 has corresponding sides 66 and 67 tapered. The top surface 68 of striker 52 is tapered inwardly and the top surface 69 of striker 53 is similarly tapered.

It will be understood that the above mentioned clearances and tapers are in the order of a few thousanths or sufficient to permit movement of the strikers relative to each other and particularly for effecting a pivoting action as commented on shortly.

The strikers are urged in a direction away from one another by spring means such as a leaf spring 70 disposed in slot 71 of the striker 53 and bowed outwardly so that the outer surface engages the slot 71*a* of striker 52. The spring is mounted so that its forces act in the lower part of the strikers.

The above mentioned clearances and the force of the spring permit the upper heads 57 and 58 to move toward each other and the lower heads to move away from one another. The effect is that the strikers slightly pivot about imaginary axis respectively located in the upper heads 57 and 58.

The spring 70 moves the strikers until the respective sides 64 and 66 engage the cavity walls. This positions the heads 54 and 55 so that the same are sufficiently spaced apart to receive a contact body therebetween as noted in FIGS. 2 and 3.

Movement or pivoting motion of the strikers toward each other is generated during the working operation as will be explained in the description below.

The working head 54 of striker 52 has a concave interior contoured working surface 72 which is co-extensive with the striker. The working head 55 of striker 53 has a similar working surface 73. As observed the working surfaces 72 and 73 face one another.

On the outside of the working head 54 is formed the follower surface 74 which is also co-extensive with the striker. The working head 55 has a similar follower surface 75. The die pad 11 has block 76 having cam surfaces 77 and 78 positioned to be engaged respectively by the follower surfaces 74 and 75 when the punch pad bolster is moved down in the working stroke.

As shown, the follower surface 74 and 75 and the cam surfaces 77 and 78 are oriented at an angle of 45° to the vertical. Other angles may be used as will be commented on later.

When the punch pad bolster 14 moves in the working stroke and the follower surfaces 74 and 75 engage the cam surfaces 77 and 78, the top surfaces 68 and 69 of the strikers engage the thrust surface 79 of the cavity 51. This engagement carries the strikers down against the upward thrust generated during the remainder of the working operation.

The combined downward motion of the strikers and the camming action of the follower surfaces 74 and 75 on the cam surfaces 77 and 78 causes the strikers to move or pivot so that the working heads 54 and 55 move toward one another and the upper heads 57 and 58 move away from one another. Thus, the strikers effectively pivot but in the opposite direction as commented on above. The resultant motion of each working head 54 and 55 is along an axis of 45°.

From the foregoing comments, it will be apparent that as the working stroke proceeds the working heads 54 and 55 first enter the spaces respectively on opposite sides of the contact body to be worked. With further movement in the working stroke, the follower surfaces engage the cam surfaces which directs the working heads toward each other down along 45° paths and the working surfaces 71 and 72 begin to approach the side edges 38*a* and 38*b* of the contact body 38.

Figures 3A, 3B, 3C:
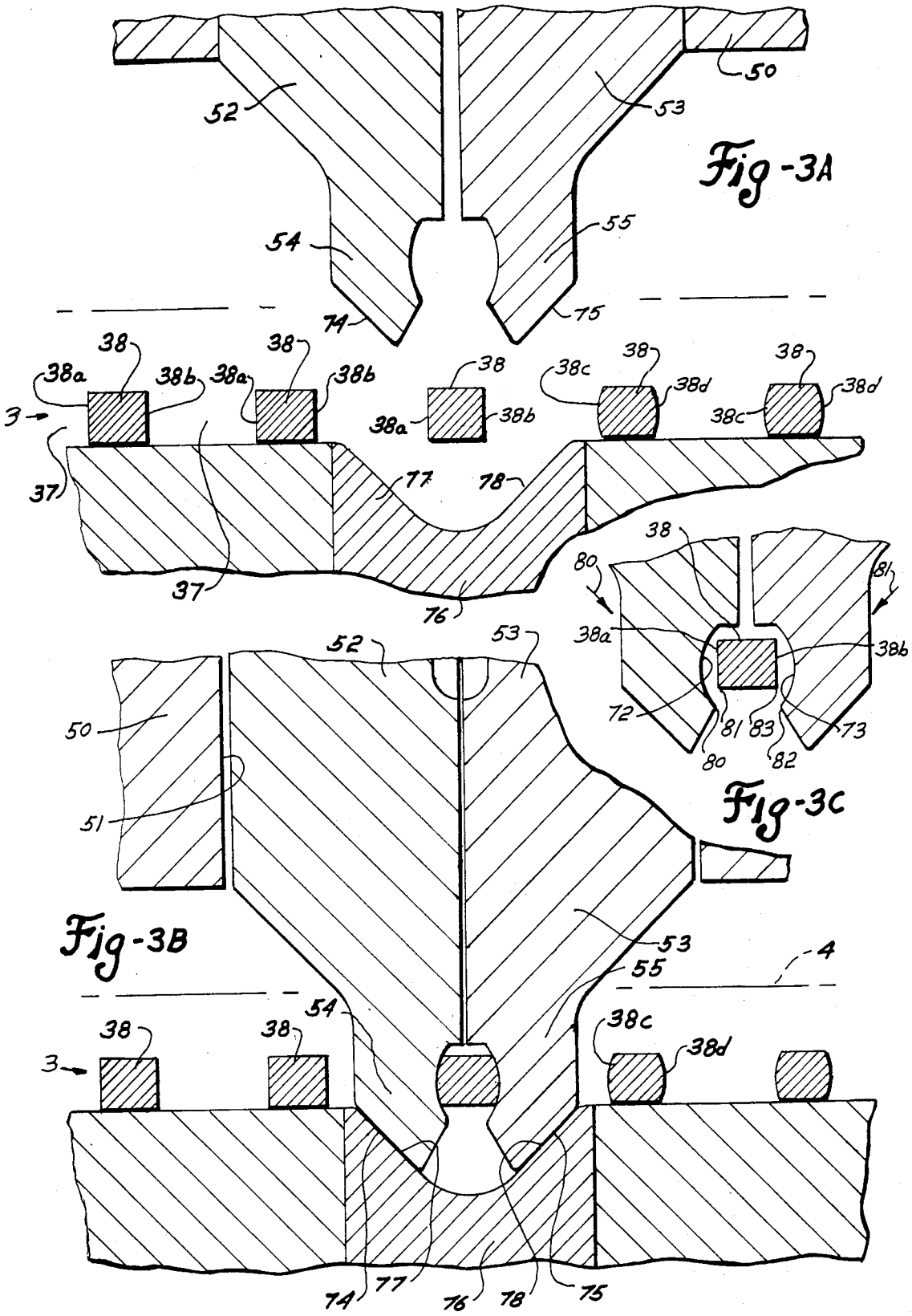

In FIG. 3C I have illustrated the position of the working surfaces 72 and 73 just before impact. The working surfaces have moved down 45° paths (arrows 80 and 81) and the lower corner 80 of surface 72 is just slightly spaced from and below the lower corner 81 of the contact body 38. The lower corners 82 and 83 are similarly situated. With continued motion along the 45° paths the lower corners 80 and 82 of the heads will move in and under the corners 81 and 83 and the working surfaces 72 and 73 begin to hug or impact the side edges 38*a* and 38*b* and contour the same as indicated at 38*c* and 38*d*. These are the operating surfaces.

The impact between the working surfaces 74 and 75 and the side edges 38*c* and 38*d* is substantial and the metal is upset or deformed by the working surfaces 72 and 73 and moved to fit the contour of the working surfaces. At the fully down position of the punch pad bolster (end of working stroke), the working surfaces will have completed working or contouring of the side edges as noted in FIG. 3B. In connection with a fully down position, it is pointed out that the tapered surfaces 65 and 67 of the strikers do not engage as otherwise such engagement would limit the inward movement of the striker working surfaces and, therefore, not effect the desired upsetting of the metal.

The respective contouring forces imparted by the surfaces 72 and 73 during working strokes of the die for the contouring of the opposite side edges are, of course, opposed, simultaneously applied forces and respectively comprise vertical and horizontal components; i.e. components normal and parallel to the plane of the strip 3.

From an inspection of FIG. 3B it will be noted that the worked edges, i.e. the operating surfaces 38*c* and 38*d* are semi-cylindrical and are continuous. Thus, the operation leaves no discontinuation of uneven surface condition capable of scraping or damaging the plated gold surface of a mating connector.

After the working operation, the punch pad bolster begins to move up to the return position. The force of the strikers on the contact body is immediately relieved. The force of the spring 70 takes over to cause the follower and cam surfaces to continue their engagement. This causes the strikers to move back out along the 45° paths and the working surfaces move away and clear the formed contact body for the return stroke. It will be observed that additional clearance is inherently provided since the lower part of the side edges of the contact body is reduced in size by the working operation to form the contoured side edges 38*c* and 38*d*.

While I have shown the cam and follower surfaces to be oriented at 45°, other angles may be used. For example, where waste must be reduced by having less space between contact bodies, the size of the working heads may be reduced and the entry angle made steeper. One limiting factor is that with less material there is less strength in the working heads. here must be sufficient strength so that the head will not break during its working operation.

Another example is where the contour of the side edges requires that the working surfaces be moved in at an angle which is less than 45°, i.e. more horizontal. This can be done by changing the vertical vector. Thus, the block 76 can be mounted to be movable upwardly as the strikers are moving down to shorten the vertical vector. The up and down movement of the block 76 is coordinated with the up and down movement of the punch pad bolster.

While in the embodiment of FIGS. 2, 3A, and 3B, I have shown the surfaces 38*a* and 38*d* to be semi-cylindrically shaped, it will be understood that other shapes are to be employed as will be commented on later.

It will be understood that plural tools may be employed. For example, it may be desirable because of physical limitations and/or of strength to carry out the contouring operation on the side edges in several descrete steps and/or positions and this would require several tools serially spaced along the axis A and at different lateral positions relative to the axis.

It will be understood, of course, that the positions of the block 76 and the strikers 52 and 53 may be reversed. With this construction the up and down motion of the strikers is coordinated with the motion of the punch pad bolster so that the strikers are recessed to allow the strip to be stepped and to be elevated for the working operation.

I will now describe typical uses of the tooling 6 for the formation of operating surfaces including the formation of novel contacts both in structure per se and by that the same include such surfaces.

The first contact is one having an especially structured retention section which includes the operating surfaces. This is illustrated in FIGS. 7 and 8, part (a) through (e) respectively and in FIG. 9. In connection with FIG. 8, the sectional view of part (a) is taken as indicated by the arrow 8*a*—8*a* on FIG. 7. The sectional view in parts (b) through (e) are similarly taken on corresponding parts (b) through (e) of FIG. 7.

Referring fo FIGS. 7 and 8, parts (a), the strip 40 has been stamped with cut-outs 41 and 42 to form contact body 43 having side edges 43*a* and 43*b*. The body will be worked into the retention section. For simplicity, only one of such bodies is shown in FIGS. 7 and 8, parts (a).

The next step is to work each body 43 with the tooling of the invention to form an operating surface on each side edge. The operation is the same as that described above in connection with FIGS. 2, 3A, 3B, and 3C. The semi-cylindrical operating surfaces are indicated in FIGS. 7 and 8, part (b) by 43*c* and 43*d*.

The next step is to lance the contact body to form an inboard arm 84 and outboard arms 85 and 86. This is illustrated in parts (c) of FIGS. 7 and 8. Thereafter the outboard arms 85 and 86 are spread apart and bowed as indicated in parts (d). After the bowing operation the inboard arm 84 is then worked back to its original position as indicated in parts (e).

The foregoing forms a retention section for the contact as illustrated in FIG. 9. It will be understood that the above retention section is to be employed in any of the types of contacts described in connection with FIGS. 4, 5, and 6.

The retention section is adapted to be inserted into an aperture in a circuit board with the surfaces 43*c* and 43*d* engaging the wall of the aperture. This is illustrated in FIG. 12 where the board 90 has a bore or aperture 91 and the surfaces 43*c* and 43*d* engage the wall of the aperture.

Preferably, the operating surfaces 43*c* and 43*d* are contoured in a manner as is illustrated with reference to FIGS. 10 and 11. the surfaces 43*c* and 43*d* extend laterally throughout a substantial vertical length of the arms 85 and 86 particularly over a vertical distance at least equal to the thickness of the aperture wall. As the surfaces approach the upper and lower parts 92 and 93 they gradually approach a flat condition for purposes of simplifying the respective transitions into the upper part 92 and lower part 93. This transition is indicated in FIG. 11 where the surface 43*c* and the surface 43*d* have diminished in lateral extent as compared to the lateral extent seen in FIG. 10.

The wall of the aperture 90 may be plated or unplated. In the unplated condition, the operating surfaces 43*c* and 43*d* serve primarily as mounting surfaces while in cases where the wall is plated, the surfaces 43*c* and 43*d* serve both as mounting surfaces and as electrical transfer surfaces.

The outward bowing of the outboard arms 85 and 86 provides for the same to be flexible so that upon insertion of the arms move inwardly toward the inboard arm 84 as noted in FIG. 12. When inserted the outboard arms exert a large outward force against the wall of the aperture 91 to retain the contact in the board.

The operating surfaces 43*c* and 43*d* have a semi-circular or semi-cylindrical contour which is coordinated with the diameter of the bore or aperture in the circuit board. Thus, when the retention section is disposed in the circuit board aperture, the respective surfaces will engage the wall of the aperture and will be substantially coincident with the circumference of the aperture. Any radial plane; i.e. a plane normal to the axis of the contact and which contains these surfaces also contains segments of the aperture wall. Thus, the surfaces and segments will lie on the circumference of a circle whose center lies on the axis of the aperture and the axis of the contact which is co-axial therewith. Also, the vertical extent of the surfaces 43*c* and 43*d* is coordinated with the thickness of the circuit board so as to maintain full engagement throughout the length of the aperture as mentioned heretofore.

Comparing FIGS. 10 and 12, it will be observed that the outboard arms 85 and 85 both have been moved or flexed inwardly toward the inboard arm 84. The outboard arms are in effect leaf springs and the flexing causes each arm to generate a substantial outward force against the wall of the aperture. Assuming the use of conventional strip material, desired spring constant (for a weak or a strong spring) is obtained via arm cross-section. For example, a strip such as strip 40 [FIGS. 7 and 8, parts (a)] can be coined prior to the formation of the contact bodies 43 so as to reduce body thickness from that shown and each such body lanced [parts (c)] so the outboard arms are thinner than as shown.

The affect of the flexing, particularly in that the force functions through the large contact areas of the operating surfaces, has several advantages as will be discussed below.

In contacts of the kind in question it is important that each contact be properly aligned in the circuit board aperture since the shanks are automatically wire-wrapped by computer controlled equipment which is programed for pre-set contact position. In the contacts of the invention, the operating surfaces 43*c* and 43*d* being configured to engage the whole wall of the aperture to produce a large area type of contact (as opposed to line or point-type) and generating force over this large area enhances the desired alignment characteristic.

After the contact is mounted it is important that the same remain stable and in position even though the aperture may expand and contract as the circuit board responds to temperature change. The foregoing is especially important where the aperture is plated so that uniform electrical contact will be maintained. The spring force of the outboard arm acting over the large contact area between the operating surfaces and the wall of the aperture insures that the outboard arms will track or follow the expansion and contraction of the aperture wall and, therefore, maintain the contact firm in position.

In conventional two-arm retention sections, it is desired that spring force of the arms be of sufficient magnitude for alignment and stability but not great enough to inhibit insertion into the aperture (since multiple contacts are inserted simultaneously). So if the arms are made for weak spring action to provide easy insertion, the important characteristics of alignment and stability are sacrificed. But most important, the yield point of the metal of the arms may be exceeded during the insertion and, therefore, the arms becomes non-flexible. On the other hand, if the arms are made for very strong spring action, the easy insertion characteristic is impaired and also, the board may be distorted. The foregoing dilemma is solved by the presence of the inboard arm as will now be discussed.

The invention contemplates that the outboard arms be made so as to form relatively weak springs. The flexing force of the arms will be condusive to relatively easy insertion. The chance of the outer arms being damaged, however, is eliminated by the presence of the inboard arm.

It will be apparent that as the outboard arms begin to flex inwardly, the initial engagement with the inboard arms takes place in the upper and lower areas and increases toward the center of the arms as inward flexing continues. Total inward flexing causing the outboard arms to bottom on the inboard arm. Thus, the inboard arm constitutes a flexing control and is dimensioned (in conjunction with the outboard arm) so that the outboard arms cannot be flexed inwardly to a point where the metal of the outboard arms is strained beyond the elastic limit. Thus, the outboard arms retain their memory or remain flexible.

Normally there is not complete bottoming as it is desired that the outboard arms be capable of further inward flexing to accommodate temperature contraction of the circuit board.

The spring constant of each outboard arm is chosen so that with either minimum or maximum inward flexing there, sufficient force is developed for holding purposes.

Another important point is that weaker spring characteristic permits the tolerance on the board aperture to be increased. With large tolerance the board fabrication costs are reduced. In other words, there can be a smaller minimum diameter aperture and a larger maximum diameter with the contacts of the invention fully compatible with either one.

Another advantage to be mentioned is that with a large aperture tolerance and compatible retention sections, the likelihood of circuit board distortion when contacts are inserted and mounted is very much minimized or eliminated.

In cases where the forces generated by the retention section need to be maximized but without sacrificing the advantages of a spring, the invention contemplates use of the inboard arm to engage the wall of the circuit board aperture.

Thus, with reference to FIGS. 7 and 8, parts (c) and (d), the arm 84 in each part may be retained in the outward position rather than being pushed back to its original position as in the step of part (e).

However, the inboard arm 84 may be only slightly pushed out so that it does not contact the circuit board aperture.

The outward position of the inboard arm will be a function of the size of the circuit board aperture. In most cases the inboard arm will be spaced away from the outboard arms except at the upper and lower ends. In other designs, part of the inboard arm may lie between the outboard arms. In any case, the inboard arm serves to limit the inward flexing of the outboard arms.

When the inboard arm is positioned as just described, the outer surface is coined to have a surface consistant with the dimensions of the operating surfaces of the outboard arms and the diameter of the circuit board aperture. The coining is accomplished by punches 15 and mating dies.

Previously I mentioned that it is contemplated the prior art retention sections of the conventional contacts shown in FIGS. 4, 5, and 6 be provided with the operating surfaces of the invention, for example, having such surfaces on the side edges 22*a* and 22*b* of the contact 20 of FIG. 4, on the side edges of the contact 24 of FIG. 5, and on the side edges of the contact 29 of FIG. 6.

For the above purposes, the retention sections 22, 26, and 31 are fabricated much in the same way as explained in connection with FIGS. 7 and 8 except that in the operation shown in parts (c) of FIGS. 7 and 8, the inboard arm is completely punched out. The surfacing of the invention as applied to the retention sections of the contacts of FIGS. 4, 5, and 6 have advantages as described above, but of course, the retention section does not have the additional advantages provided by the inboard arm.

In addition to providing the surfacing of the invention on the retention section of the contact of FIG. 9 and on the retention sections of the contacts of FIGS. 4, 5, 6, and 9, all of these may be provided with other retention means as noted below.

As background for this, it will be understood (with reference to FIGS. 4, 5, and 6) that the side edges of the prior art retention sections on the contacts illustrated are planar. Thus, the cross-section of each retention section is rectangular and when the retention section is inserted in the circuit board aperture the four corners indent the wall of the aperture to provide a mechanical grip.

Where similar mechanical indentation is desired, when employing the surfaces of the invention, the same may be formed with indentation means in the form of wedging sections or fins. In such cases, the tooling 6 is modified to provide the fins along the opposite edges of the operating surfaces.

Fins for contacts of the kind shown in FIG. 9 will first be explained. Thus, referring to FIG. 13, it will be noted that the surface 43*c* is provided with radially extending pairs of fins 94 and that the surface 43*d* has likewise been provided with radially extending fins 95. Similar to the surfaces 43*c* and 43*d*, the fins 94 and 95 are formed so that the greatest radial extension is over a substantial part of the center of the outboard arms and that the fins taper down to zero extention as the surface approaches the upper and lower heads 92 and 93 as indicated in FIG. 14.

When a fin type retention section is inserted in the aperture of the circuit board, the fins will indent the wall of the aperture, the indentation being such that the contact between the aperture and the surfaces 43*c* and 43*d* is maintained. This condition is shown in FIG. 15 where the pairs of fins 94 and 95 indent the aperture wall 96 of circuit board 97.

Fins for retention sections of contacts of the kind shown in FIGS. 4, 5, and 6 where the retention section has the operating surfaces of the invention will next be explained. Thus, with reference to FIGS. 16 and 17, it will be seen that the retention section 99 has outboard arms 100 and 101. The arms have operating surfaces 102 and 103 and also have pairs of fins respectively 104 and 105. The fins 104 and 105 function in the same way as described in connection with FIG. 15 as will be seen from inspection of FIG. 17 where the retention section 99 has been inserted in the aperture 106 of the circuit board 107.

As previously indicated, the invention contemplates that (in addition to providing operating surfaces on the retention section of a tuning fork) the tooling be employed to provide contact surfaces on the contact section of a tuning fork such as a tuning fork of the kind shown in FIG. 6.

Referring to FIG. 6, it will be recalled that the conventional tuning fork has a shank section 30, a retention section 31, and a contact section 32 which comprises the forks 33 and 34 having heads 35 and 36 with the facing interior side edges 35*a* and 36*a*. In FIG. 18 parts (a)–(d), I have illustrated how a tuning fork contact section, such as contact section 32 of FIG. 6, is fabricated and provided with contact surfaces on the facing interior side edges.

In FIG. 18 only that portion of the strip which will be worked to form the contact section is illustrated. The retention section and shank section are not shown as these are formed in other portions of the progressive die.

In FIG. 18, part (a), strip 110 is provided with v-shaped identical cut-outs 111 which form identical contact bodies 112, 113, 114, 115, etc. having identical heads 116, 117, 118, and 119.

The side edges of the heads 116–119 are then worked with the tooling of the invention to form contact surfaces **116*b*–117*a*, 117*b*–118*a*, and 118*b*–119*a*** which are semi-spherical.

After forming the contact surfaces, the contact bodies and heads are then split [part (c)] by forming identical cut-outs 120–123. Next, the split contact bodies are worked so that the facing semi-spherical surfaces are brought closer to each other as is illustrated in part (d). This forms pairs of tuning forks 124–125, 126–127, and 128–129. These pairs correspond to the pairs of tuning forks 33 and 34 of FIG. 6. The facing surfaces **116*b*–117*a*, 117*b*–118*a*, and 118*b*–119*a* correspond to the facing surfaces 35*a* and 36*a* mentioned in connection with FIG. 6**.

While I have described the contact surfaces for the tuning fork to be semi-spherical, these surfaces may be concave or flat. For example, with certain IC connections having a round pin rather than a blade, the contact surfaces are made compatible by forming the same with a concave contour. In cases where the circuit design required large current transfer, the contact surfaces are formed flat so as to provide a large contact surface with the blade. In such instances, the contact sections are stamped so as to enhance their ability to axially rotate and thus, allow the flat surface on the head to fully engage with the flat surface on the blade.

I claim:

1. An electrical contact including a retention section extending along the axis of the contact, the retention section to be press-fitted into an aperture in contact support means to mount the contact on the support means, the retention section comprising:

three spaced apart, axially extending arms, there being an inboard arm and a pair of outboard arms respectively disposed on opposite sides of the inboard arm and each outboard arm being bowed outwardly;

each said outboard arm having an exterior convex operating surface to engage the wall of the aperture when the retention section is inserted therein;

said outboard arms being flexible whereby to flex toward said axis upon insertion of the retention section in said aperture and flex toward and away from said axis upon contraction and expansion of said aperture due to change in temperature of said contact support means, the flexing of the arms developing forces to retain the retention section in the aperture;

the relative positions of said outboard arms and said inboard arm and the magnitude of said flexing toward said axis of each outboard arm being such that each outboard arm engage said inboard arm so that it does not touch the other outboard arm and to prevent the metal of each outboard arm from being strained beyond the yield point thereof; and said exterior convex operating surfaces being characterized by that in any radial plane normal to said axis and through the surfaces, the locus of each operating surface lies substantially in the circumference of a circle whose center lies in said axis and said inboard arm being configured so as to be spaced from the wall of said aperture when the retention section is inserted therein.

2. An electrical contact including a retention section extending along the axis of the contact, the retention section to be press-fitted into an aperture in contact support means to mount the contact on the support means, the retention section comprising:

three spaced apart, axially extending arms, there being an inboard arm and a pair of outboard arms respectively disposed on opposite sides of said inboard arm and each of said inboard and outboard arms being bowed outwardly;

each said outboard arm having an exterior convex operating surface to engage the wall of the aperture when the retention section is inserted therein;

said outboard arms being flexible whereby to flex toward said axis upon insertion of the retention section in said aperture and flex toward and away from said axis upon contraction and expansion of said aperture due to change in temperature of said contact support means, the flexing of the arms developing forces to retain the retention section in the aperture;

the relative positions of said outboard arms and said inboard arm and the magnitude of said flexing toward said axis of each outboard arm being such that each outboard arm engage said inboard arm so that it does not touch the other outboard arm and to prevent the metal of each outboard arm from being strained beyond the yield point thereof; and said exterior convex operating surfaces being characterized by that in any radial plane normal to each axis through the surfaces, the locus of each operating surface lies substantially in the circumference of a circle whose center lies in said axis and said inboard arm being configured so as to be spaced from the wall of said aperture when the retention section is inserted therein.

3. An electrical contact including a retention section extending along the axis of the contact, the retention section to be press-fitted into an aperture in contact support means to mount the contact on the support means, the retention section comprising:

three spaced apart, axially extending arms, there being an inboard arm and a pair of outboard arms respectively disposed on opposite sides of the inboard arm and each outboard arm being bowed outwardly;

each said outboard arm having an exterior operating convex surface and a pair of fins respectively on the opposite edges of the convex operating surface, each fin extending axially along its operating surface and also extending generally radially outwardly of its operating surface, the convex operating surfaces being for use in engaging the wall of the aperture and the fins being for use in pressing into the wall of the aperture when the retention section is inserted therein;

said outboard arms being flexible whereby to flex toward said axis upon insertion of the retention section in said aperture and flex toward and away from said axis upon contraction and expansion of said aperture due to change in temperature of said contact support means, the flexing of the arms developing forces to retain the retention section in the aperture;

the relative positions of said outboard arms and said inboard arm and the magnitude of said flexing of each outboard arm being such that each outboard arm engage said inboard arm so that it does not touch the other outboard arm and to prevent the metal of each outboard arm from being strained beyond the yield point thereof; and said exterior convex operating surfaces being characterized by that in any radial plane normal to said axis and through the surfaces, the locus of each surface lies substantially in the circumference of a circle whose center lies in said axis and said inboard arm being configured so as to be spaced from the wall of said aperture when the retention section is inserted therein.

* * * * *